US007927197B2

(12) United States Patent
Bosch

(10) Patent No.: US 7,927,197 B2
(45) Date of Patent: Apr. 19, 2011

(54) AIR DIFFUSER

(75) Inventor: Christiaan Wilhelm Bosch, Ottery (ZA)

(73) Assignee: Rickard Air Diffusion (Proprietary) Limited, Ottery (ZA)

( * ) Notice: Subject to any disclaimer, the term of this patent is extended or adjusted under 35 U.S.C. 154(b) by 108 days.

(21) Appl. No.: 11/818,550

(22) Filed: Jun. 14, 2007

(65) Prior Publication Data

US 2007/0298707 A1 Dec. 27, 2007

(30) Foreign Application Priority Data

Jun. 22, 2006 (ZA) ..... 2006/05140
Nov. 29, 2006 (ZA) ..... 2006/09953

(51) Int. Cl.
*F24F 7/00* (2006.01)

(52) U.S. Cl. ..... 454/302

(58) Field of Classification Search ..... 454/302, 454/343, 243; 236/49.5
See application file for complete search history.

(56) References Cited

U.S. PATENT DOCUMENTS

| | | | | |
|---|---|---|---|---|
| 2,712,786 | A * | 7/1955 | Argentieri et al. | 454/302 |
| 5,647,532 | A * | 7/1997 | de Villiers et al. | 236/49.5 |
| 6,105,927 | A * | 8/2000 | Zelczer et al. | 251/58 |
| 6,254,010 | B1 * | 7/2001 | De Villiers | 236/49.5 |
| 2006/0052049 | A1 * | 3/2006 | Caldwell et al. | 454/302 |

* cited by examiner

*Primary Examiner* — Kenneth B Rinehart
*Assistant Examiner* — Samantha A Miller
(74) *Attorney, Agent, or Firm* — Ladas & Parry LLP

(57) ABSTRACT

A diffuser is provided for controlling flow of air in an air conditioning system. The diffuser has an air flow control baffle (B) that is controlled by pivoting arms (12). Two collars (62,62) actuate the arms (12) in cam fashion by acting on either of two cam surfaces (92,94) of each arm (12) to open or close the baffle (B). The collars (62,64) can move independently of each other towards and away from the respective cam surfaces (92,94), i.e. in an actuating direction. The diffuser includes a set point adjustment mechanism (132) for moving both the collars (62,64) in unison in the actuating direction, i.e. to adjust the heating and cooling set points simultaneously and includes an offset adjustment mechanism (150) for moving one of the collars (62,64) in the actuating direction relative to the other collar, i.e. to change the offset between the heating and cooling set points.

7 Claims, 10 Drawing Sheets

AIR DIFFUSER

FIELD OF THE INVENTION

This invention relates to air diffusers.

BACKGROUND TO THE INVENTION

For the purposes of this specification, the term "diffuser" is used to designate those devices which, in air conditioning systems, are employed for the purpose of regulating flow of air, which may be heated air or cooled air, from air conditioning ducting into a room.

Various conditions occur in an air conditioned room depending on whether the outside temperature is above or below that at which the room is to be maintained, i.e. above or below the so-called "set point". Thus in cooling or "summer" conditions, the diffuser should control the rate at which cooled air is fed to a room and in heating or "winter" conditions, the diffuser should similarly control the rate at which heated air is fed to the room.

It is often desirable for an air conditioning system, or more particularly for a diffuser, to have different set points for cooling and heating conditions. The reasons may partly be because of personal preferences of occupants of the rooms, but typically, people dress according to the ambient temperatures and their bodies adjust to the ambient temperature, so that they can tolerate some degree of cold when it is cold outside and can tolerate some degree of heat if it is hot outside. In fact, occupants of air conditioned spaces where temperatures are kept perfectly constant usually experience these spaces as too hot when it is cold outside and/or too cold when it is hot outside. Experience has shown that most occupants of air conditioned spaces are most comfortable if the set point during cooling (summer) conditions is about one to two degrees Celsius higher than the set point for heating (winter conditions). This temperature difference between cooling and heating set points will be referred to in this specification as the "offset".

In addition to the advantages that such an offset has for comfort, it also saves considerable amounts of energy in avoiding unnecessary cooling and/or heating. Further, apart from the savings in energy costs, the lower energy consumption is also important in striving for the provision of buildings that are more environmentally friendly, or so-called "green buildings".

In the specification of South African Patent Application No. 2005/06813, the entire contents of which is included herein by reference, (corresponding to U.S. Pat. No. 7,189,159 and Australian Patent Application No. 2005205768) diffusers are disclosed in which the set points in respect of cooling and heating conditions can be adjusted independently of each other. In the diffusers disclosed in each of these patent specifications, there is an adjustment element that can be rotated to adjust the set point for heating conditions and similarly, there is a substantially identical adjustment element that can be rotated to adjust the set point for cooling conditions.

The independent adjustment of set points for heating conditions and cooling conditions make these systems prone to loosing its offset. What typically happens is that a user who prefers a cooler environment feels hot during cooling conditions (summer) and adjusts the cooling set point downwardly without adjusting the heating set point, thus reducing the offset. When the diffuser is then operated in heating conditions (winter), the original heating set point is maintained, even though it would have been more comfortable for the user and less heating energy may have been used if the heating set point were also lowered, i.e. the offset were maintained. Similarly, energy wastage and/or discomfort can occur in the exact opposite scenario, if the offset is reduced by raising the heating set point without raising the cooling set point and energy is subsequently wasted in excessive cooling.

The desirability of maintaining an offset and/or the quantum of the offset can vary depending on the particular use of the diffuser. An increase in the offset may for instance improve energy efficiency, but can cause some discomfort and a balance may need to be struck between these two considerations, which suits the particular case. It may be that in spaces that are less prone to temperature variations, the cost of heating and/or cooling is minimal and only a small or no offset is desirable. Accordingly, some users may require the capability to adjust the offset.

The present invention seeks to provide an improved diffuser that allows convenient simultaneous adjustment of its set points for heating and cooling conditions, while maintaining an offset and that allows its offset to be adjusted.

BRIEF DESCRIPTION OF THE INVENTION

According to one aspect of the present invention there is provided a diffuser for controlling flow of air in an air conditioning system, the diffuser including:

- an air flow control baffle;
- at least one pivotally mounted arm with an end connected to the baffle, said arm having a first cam surface on one side of its pivotal mounting and a second cam surface on the other side of its pivotal mounting;
- a first control element having a first surface for bearing on said first cam surface and a second control element having a second surface for bearing on said second cam surface, said respective control elements being movable in an actuating direction towards and away from the respective cam surfaces; and
- a set point adjustment mechanism, configured to move both the first and the second control elements in unison in the actuating direction;
- wherein said diffuser includes an offset adjustment mechanism, configured to move the first control element in the actuating direction relative to the second control element.

The set point adjustment mechanism may include

- a first rotary element bearing on the first control element and including a helical formation, configured such that rotation of the first rotary element causes displacement of the first control element in the actuating direction;
- a second rotary element bearing on the second control element and including a helical formation, configured such that rotation of the second rotary element causes displacement of the second control element in the actuating direction; and
- at least one connector extending between the first rotary element and the second rotary element, said connector causing the first rotary element and the second rotary element to be rotated together, causing displacement of the first and second control elements in unison, in the actuating direction.

The diffuser may include a compression spring that extends between the control elements, urging them to abut their respective rotary elements.

The offset adjustment mechanism may include an offset adjustment element bearing on the helical formation of the first rotary element, rotation of the offset adjustment element causing displacement of the first rotary element and the first control element, in the actuating direction.

The offset adjustment mechanism may be configured to limit rotation of the offset adjustment element and thus to limit movement of the first rotary element and the first control element so that the set point for a heating condition of the diffuser is always lower than the set point for a cooling condition of the diffuser or to maintain a predetermined minimum offset between the respective set points for the heating and cooling conditions.

BRIEF DESCRIPTION OF THE DRAWINGS

For a better understanding of the present invention, and to show how the same may be carried into effect, reference will now be made, by way of non-limiting example, to the accompanying drawings in which.

DETAILED DESCRIPTION OF THE DRAWINGS

Figure 1:
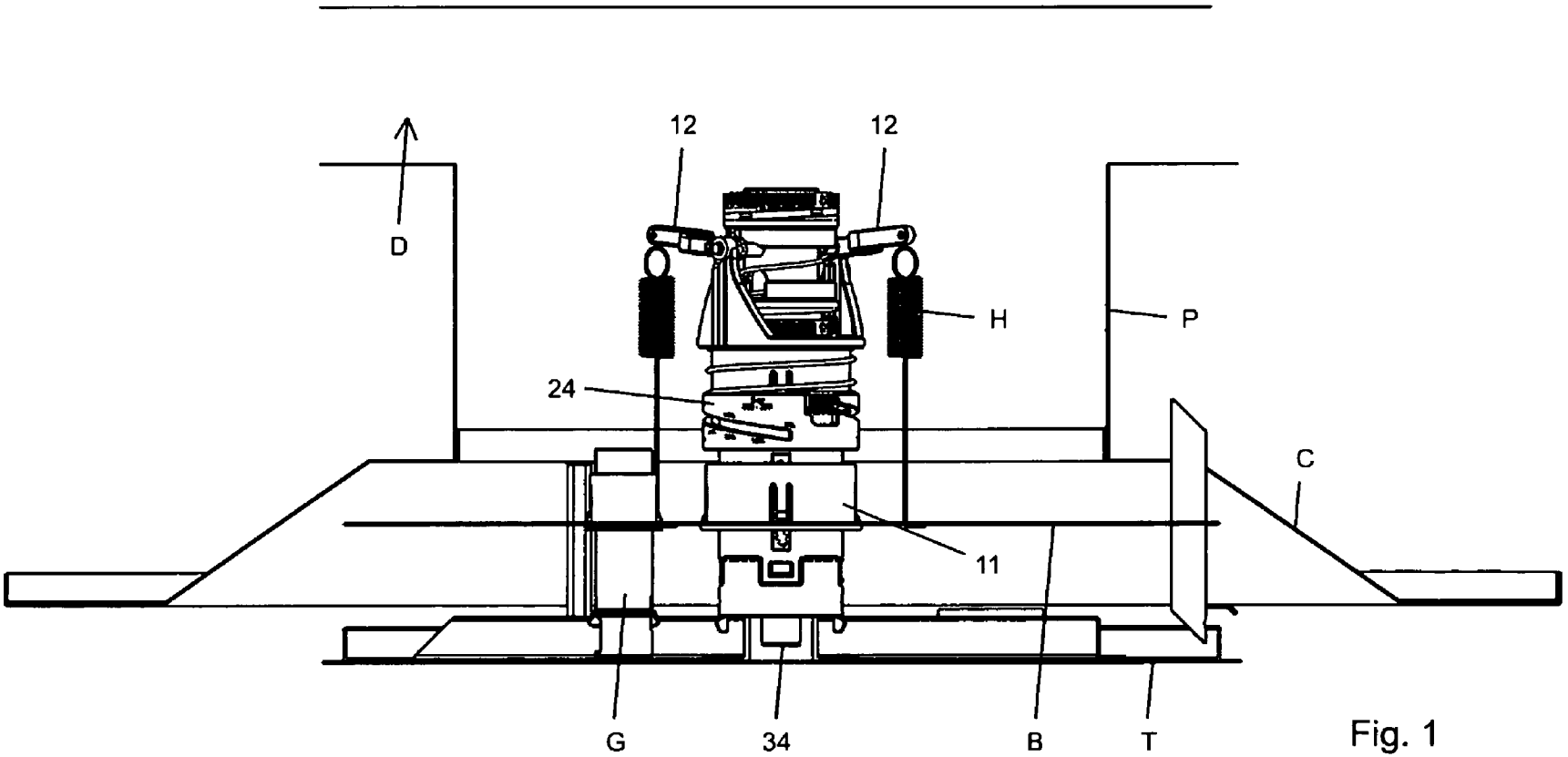
FIG. 1 is a diagrammatic cross section through a typical air diffuser in accordance with the prior art.
Figure 2:
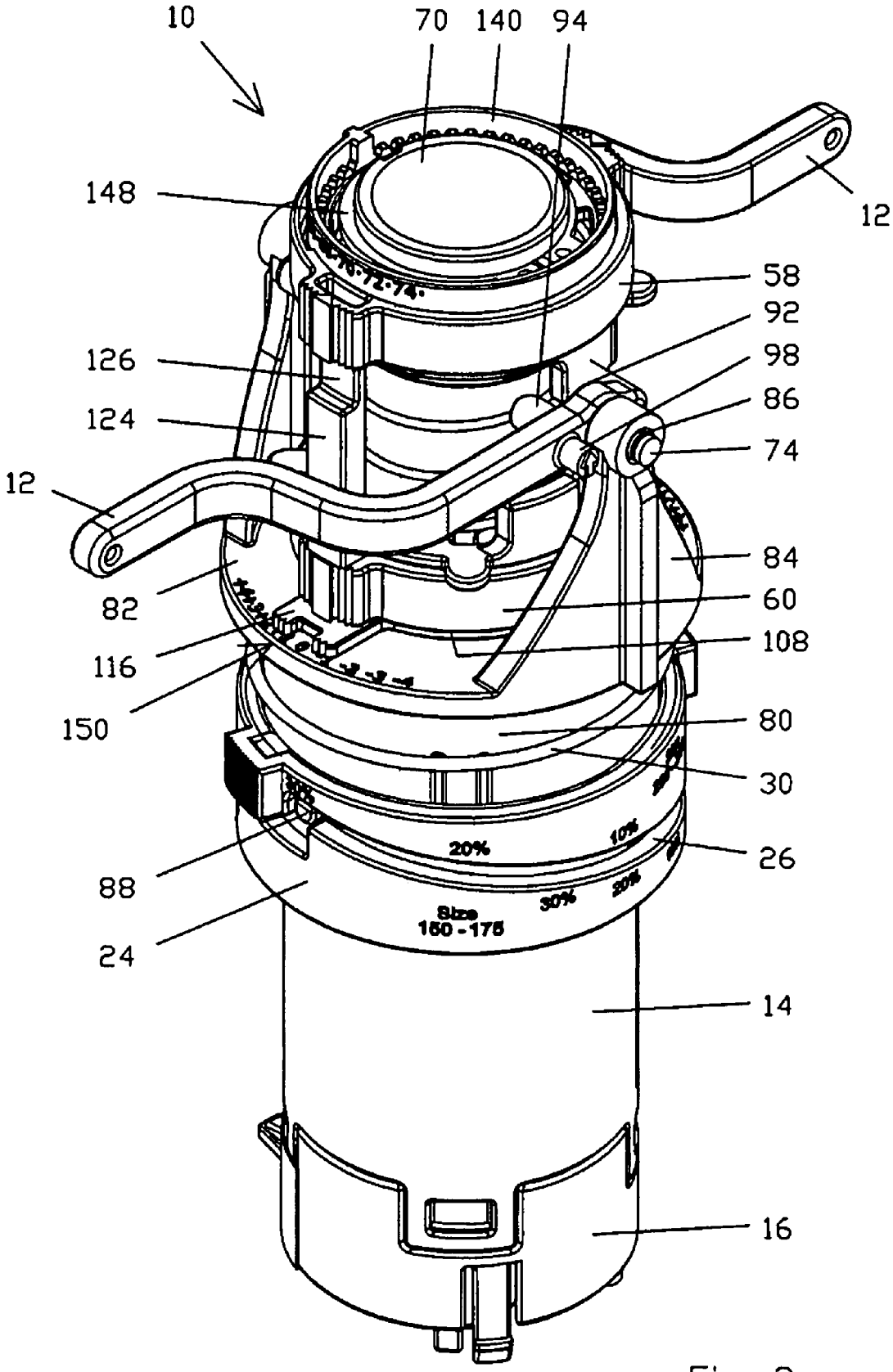
FIG. 2 is a three dimensional view of a cartridge in accordance with the present invention for controlling an air diffuser such as that of FIG. 1.
Figure 3:
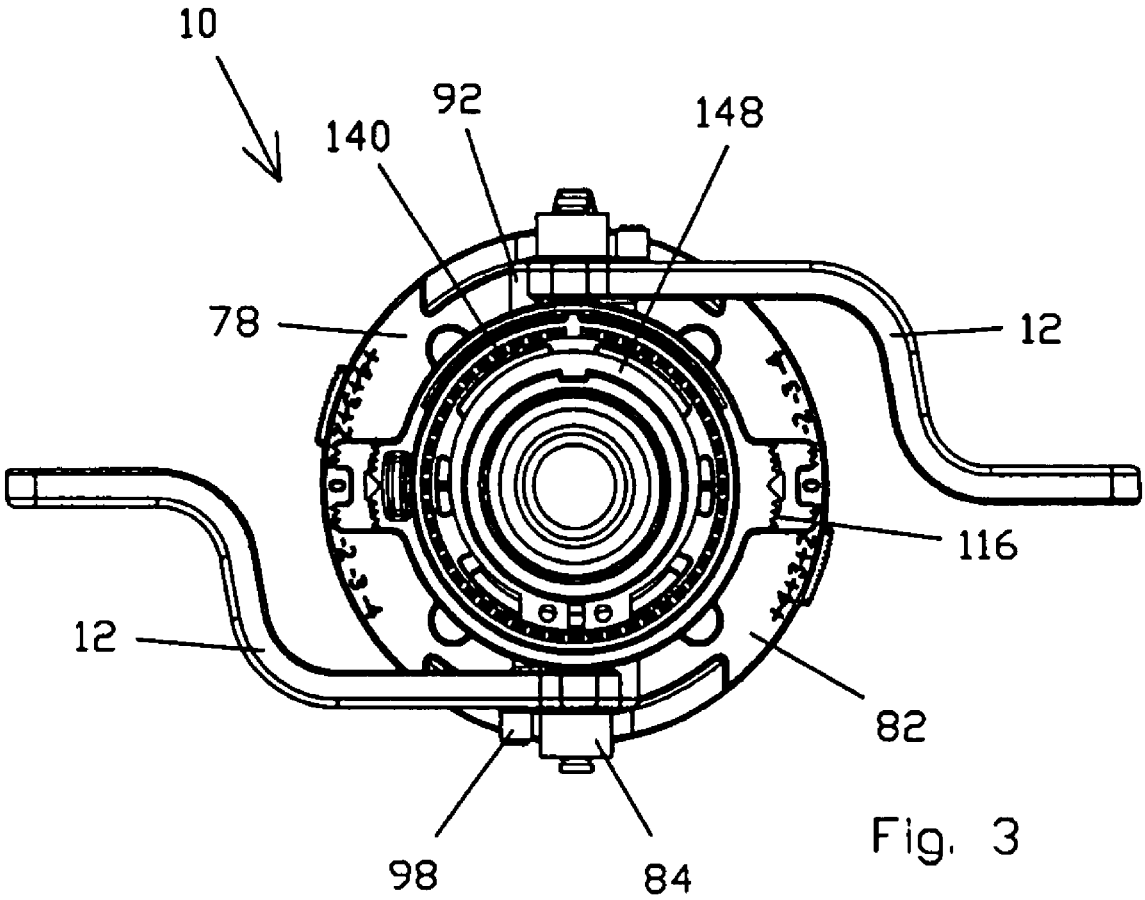
FIG. 3 is a top plan view of the cartridge of FIG. 2.
Figure 4:
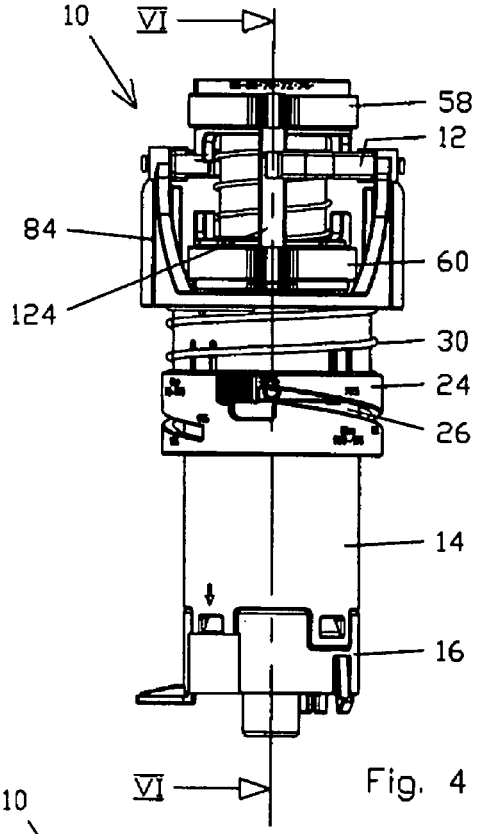
FIG. 4 is a side view of the cartridge of FIG. 2.

Referring firstly to FIG. 1, the reference D designates a duct through which heated or cooled air flows depending on atmospheric conditions.

The pipe P extends downwardly from the duct D and within this is a cartridge that moves a baffle B up and down with respect to a casing C thereby to control airflow. The baffle B is carried by spring hangers H which extend downwardly from arms 12 that protrude outwardly from the cartridge. A guide for the baffle B is shown at G and a trim plate at T. The centre of the baffle B includes a short cylindrical stopper 11 that is coaxially guided by the cartridge. The lower end of the cartridge is fixedly attached to the trim plate T, which is fixedly attached to the casing C, these parts all being stationary.

The diffuser illustrated in FIG. 1 is also described and illustrated in South African Patent Application No. 2005/06813 (corresponding to U.S. Pat. No. 7,189,159 and Australian Patent Application No. 2005205768) and is described in this specification only to show the practical application of a cartridge for a diffuser of this type. The remainder of the drawings show a cartridge in accordance with the present invention, that is generally indicated by reference numeral 10 and that performs the same basic function as the cartridge shown in FIG. 1, of lifting and lowering the arms 12 to control the position of the baffle B and thus the flow of air from the duct D to the room below. However, the manner in which the cartridge 10 of the present invention performs this function is significantly different. Only components that form part of the cartridge 10 and arms 12, are shown in FIGS. 2 to 22 and the remaining parts of the diffuser shown in FIG. 1 have been omitted.

The cartridge 10 comprises an outside tube 14 to which a bottom cap 16 is fitted. The tube 14 has an internal flange 22 at its upper end (see FIGS. 6 and 7).

A flow adjustment ring 24 encircles the tube 14 and has in it two helical spiral slots 26. The ring 24 limits upward movement of the baffle B by limiting upward movement of the stopper 11 and thus determines the minimum air flow that can occur in the fully raised position of the baffle B. Above the adjustment ring 24 there is a spring 30 which presses down on the ring 24. The spring 30 serves to prevent the ring 24 from rotating out of the position to which it has been adjusted.

Figure 6:
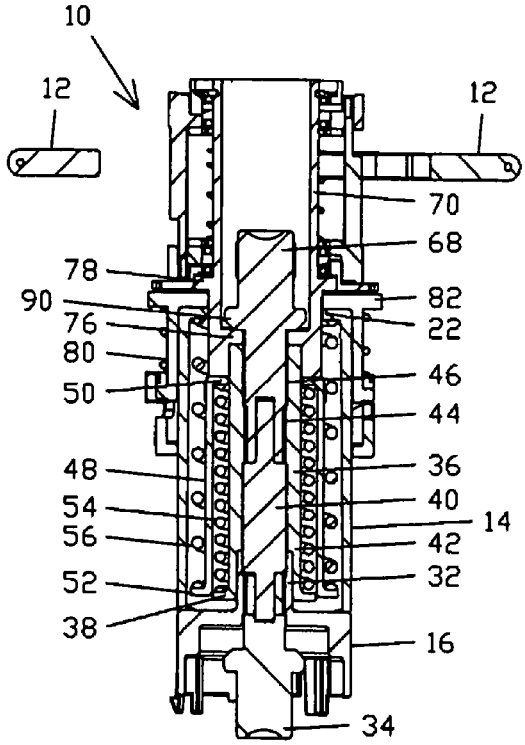
FIG. 6 is a section on the line VI-VI of FIG. 4.
Figure 5:
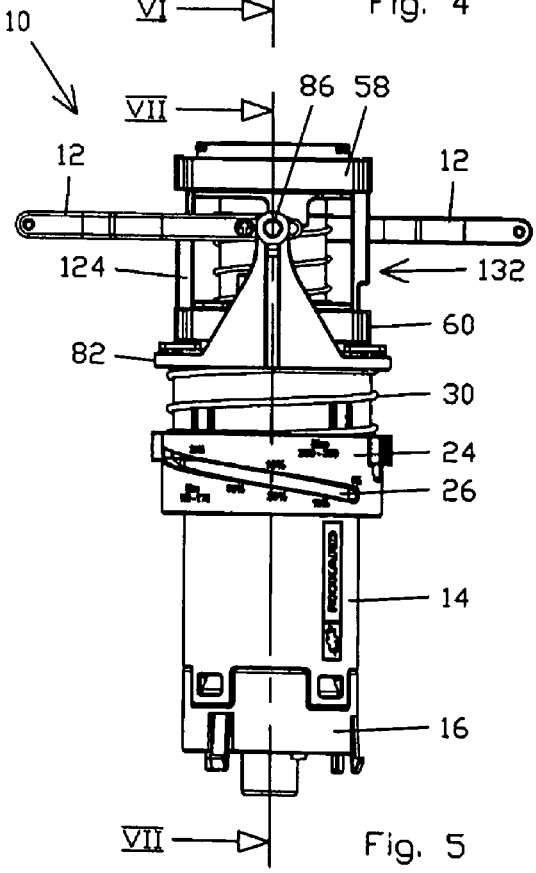
FIG. 5 is a front view of the cartridge of FIG. 2.
Figure 7:
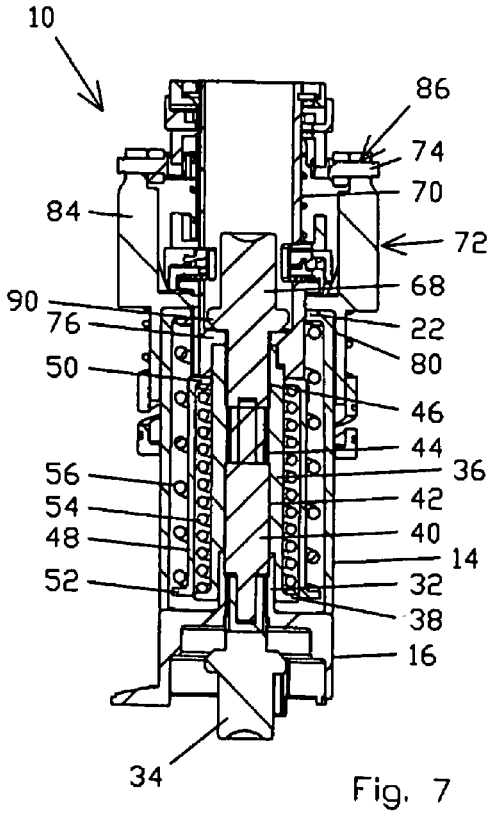
FIG. 7 is a section on the line VII-VII of FIG. 5.

Referring now specifically to FIGS. 6 and 7, the bottom cap 16 includes a spigot 32 which is internally threaded and into which a temperature sensitive element 34 is screwed. The element 34 protrudes downwardly from the bottom cap 16. The temperature sensitive elements to which reference is made herein are of a type that is filled with wax that expands at a predetermined rate as its temperature increases, thus expanding the temperature sensitive element by advancing a piston in an axial direction.

A spindle casing 36 slides on the spigot 32 of the end cap 16 and has an outwardly directed lower flange 38. A spindle 40 is fitted inside the spindle casing 36. The spindle casing 36 has a cylindrical portion 42, an internally threaded section 44 and a socket 46.

An intermediate tube 48 is provided between the spindle casing 36 and the tube 14. The intermediate tube 48 has an internal flange 50 at the upper end thereof and an external flange 52 at the lower end. An inner helical spring 54 is located between the flanges 38 and 50, and an outer helical spring 56 is located between the flanges 22 and 52. The two springs 54 and 56 act in series to resist compression of the flange 38 relative to the flange 22, i.e. to resist upward movement of the spindle casing 36 relative to the outside tube 14, by transferring compressive loads from one spring to the other, via the intermediate tube 48. The arrangement with the inner spring 54 nested coaxially in series within the outer spring 56, allows the spring arrangement to work, while restricting its vertical length, i.e. the height of the cartridge 10.

A thermally sensitive element that is exposed to duct temperature is shown at 68 and an adjustment tube is shown at 70. The arms 12 are secured to a support 72 by means of two pins 74 (also see FIG. 8). The adjustment tube 70 has an internal flange 76 and an external flange 78. The tube 70 receives the temperature sensitive element 68, the lower part of which is screwed into the threaded section 44 of the spindle casing 36. The spindle 40 is between the pistons of the temperature sensitive elements 34 and 68.

The support 72 for the arms 12 encircles the tubes 14 and 70 and comprises a sleeve 80 with a flange 82 (also see FIG. 5) at its upper end of the sleeve 80. Trunnions 84 extend upwardly from the flange 82 and have holes 86 (also see FIG. 5) in bosses at the upper ends of the trunnions. The sleeve 80 fits inside the ring 24 and two spigots 88 (also see FIGS. 2 and 8) of the sleeve fit into the spiral slots 26. Thus as the ring 24 is turned, it is displaced axially with respect to the sleeve 80 and the tube 14.

Figure 8:
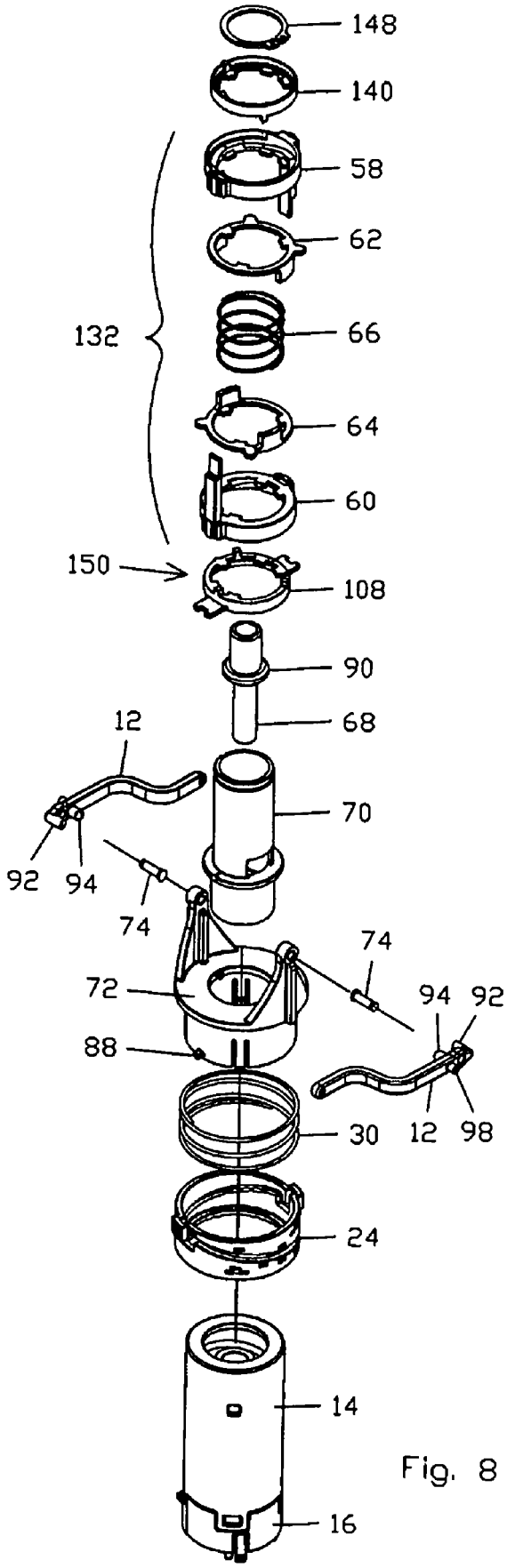
FIG. 8 is an exploded view of the cartridge of FIG. 2.

Referring to FIG. 8, the tube 70 is secured to the spindle casing 36 by an external flange 90 of the element 68 which bears on the internal flange 76 of the tube 70 and presses it against the top of the spindle casing 36.

The arms 12 each have two protruding bosses 92, 94 and a hole between these bosses, in which the arm receives its mounting pin 74. The circumference of the boss 92 forms the first cam surface of each arm 12 and can operate cam-fashion to pivot the arm when pressed from above and similarly, the circumference of the boss 94 of each arm, on the other side of the pivotal mounting pin 74, forms the second cam surface of the arm 12 and can operate cam fashion to pivot the arm in the opposite direction when pressed from below. Bosses 98 (see FIGS. 2, 3 and 8) limit the distance through which the arms 12 can pivot downwardly, by abutting the trunnions 84 adjacent the bosses.

The cartridge 10 includes two control elements in the form of two collars 62 and 64, spaced apart by a helical spring 66. The first or top collar 62 is configured to co-operate with the bosses 92 and the second or bottom collar 64 is configured to co-operate with the bosses 94, as the collars are moved up and down in an actuating direction. Above the top collar 62, there is a top set point adjustment ring 58, which controls the position of the top collar relative to the adjustment tube 70 and similarly, there is a bottom set point adjustment ring 60 below the bottom collar 64, which controls the position of the bottom collar relative to the adjustment tube. The top and bottom collars 62 and 64 are identical in construction, but inverted in orientation and similarly, the top and bottom set point adjustment rings 58,60 are identical, but inverted.

Figure 9:
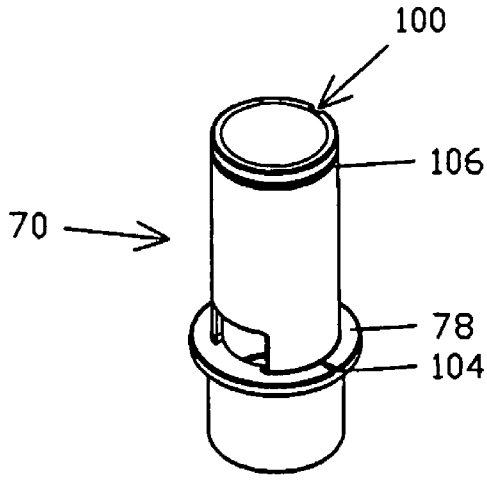
FIG. 9 is a three dimensional view of an adjustment tube of the diffuser of FIG. 2.
Figure 10:
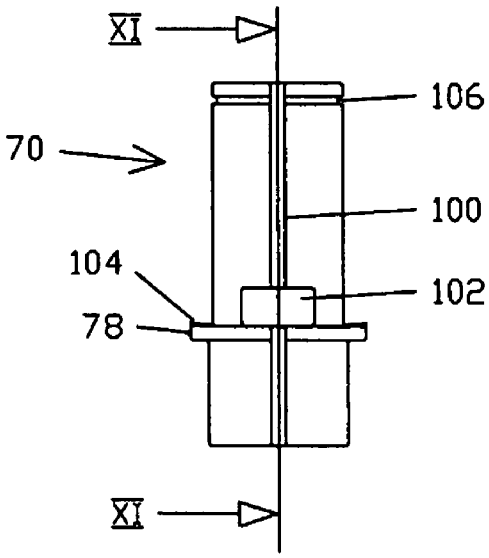
FIG. 10 is a side view of the adjustment tube of FIG. 9.
Figure 11:
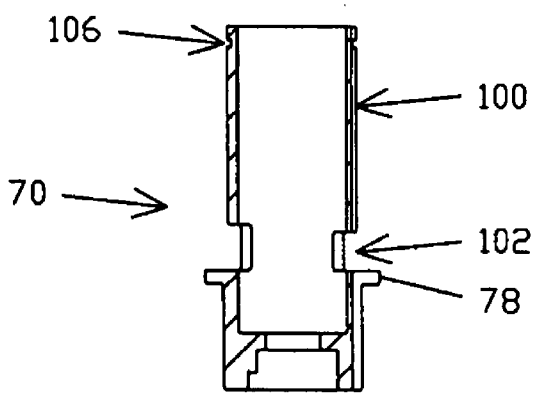
FIG. 11 is a section on the line XI-XI of FIG. 10.

Referring to FIGS. 9 to 11, the adjustment tube 70 defines a longitudinal groove 100 that extends through a rectangular window 102, defined immediately above its flange 78. The tube 70 also defines two radial ribs 104 on top of the flange 78 and defines a circumferential groove 106 near its top.

Figure 12:
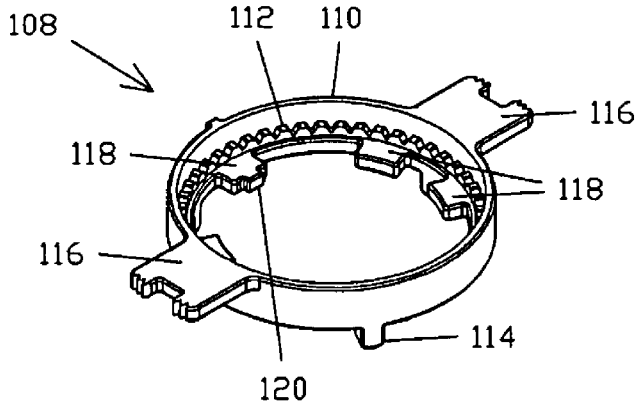
FIG. 12 is a three dimensional bottom view of an offset adjustment ring of the diffuser of FIG. 2.
Figure 13:
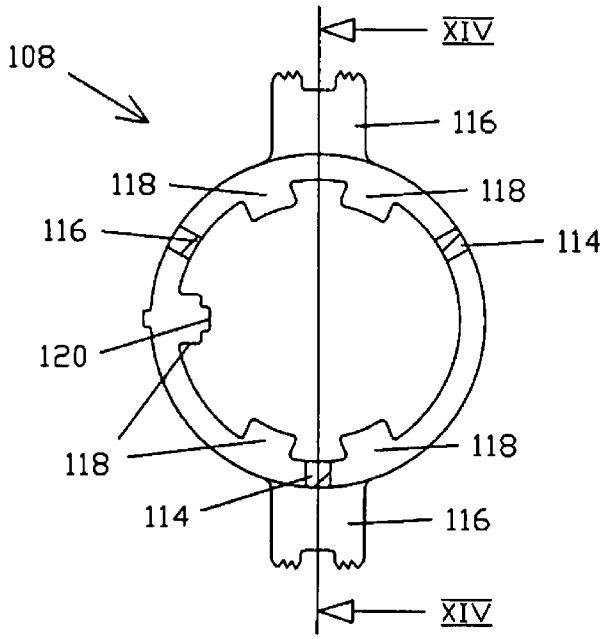
FIG. 13 is plan view of the offset adjustment ring of FIG. 12.
Figure 14:
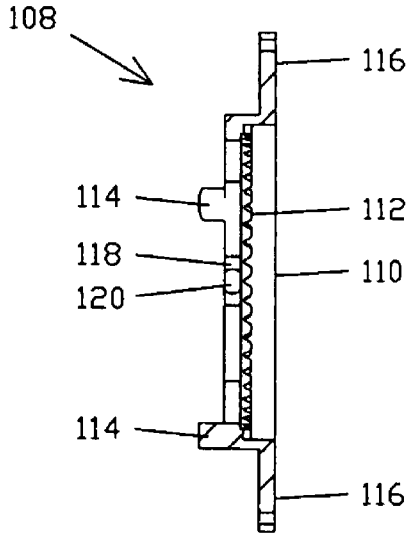
FIG. 14 is a section on the line XIV-XIV of FIG. 13.

Referring to FIGS. 12 to 14, the cartridge 10 includes an offset adjustment ring 108 that is positioned around the tube 70, immediately above the flange 78. The offset adjustment ring 108 includes a circumferential skirt 110 that fits around the flange 78 and includes a series of small teeth 112 inside the skirt on its underside. When the offset adjustment ring 108 is in position on the flange 78, the teeth 112 interact with the ribs 104 so that it can rotate in a restrained, clicking manner. On its upper side, the offset adjustment ring 108 has three circumferentially spaced protuberances 114, that abut the underside of the bottom collar 64 (see below). The offset adjustment ring also includes two radially extending grip formations 116 that extend immediately above the flange 78 and that can be gripped manually to rotate it relative to the flange. The ends of the grip formations 116 are recessed so that indexes provided on the flange 78 are visible, depending on the rotational position of the offset adjustment ring relative to the flange.

On its inside, the offset adjustment ring 108 has five inwardly extending spacers 118 and one of the spacers has a limiting key 120 at its end. The inner circumference of the spacers 118, apart from the key, is just enough to allow it to fit over the tube 70 with clearance, so that the offset adjustment ring 108 can only be fitted on the tube 70 by sliding it axially with the key 120 sliding in the groove 100 to the window 102. The rotational movement of the offset adjustment ring 108 relative to the tube 70 is limited to an extent since the key is held captive inside the window 102, but more so because of the restraining interaction between the teeth 112 and the ribs 104.

Figure 15:
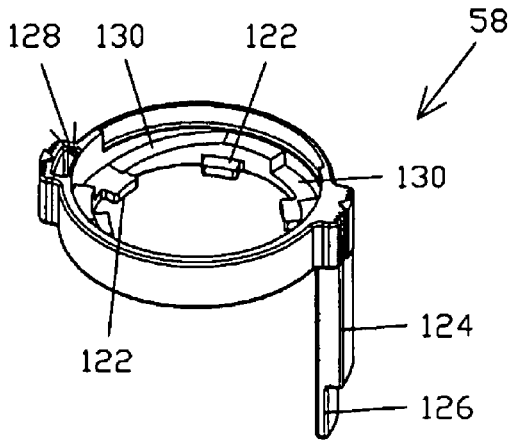
FIG. 15 is a three dimensional view of a set point adjustment ring of the diffuser of FIG. 2.
Figure 16:
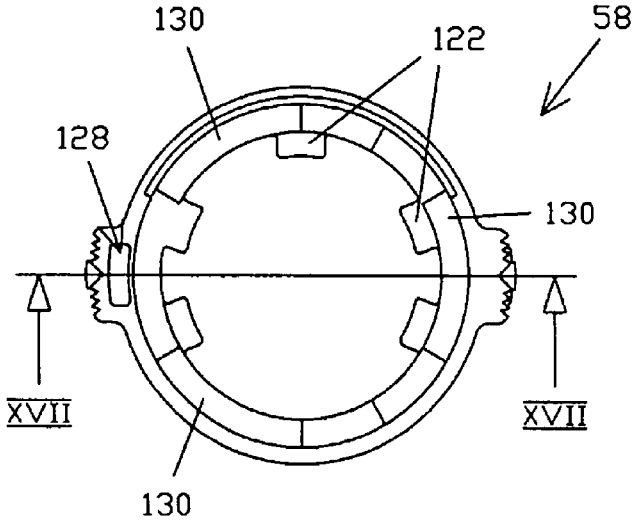
FIG. 16 is a plan view of the set point adjustment ring of FIG. 15.
Figure 17:
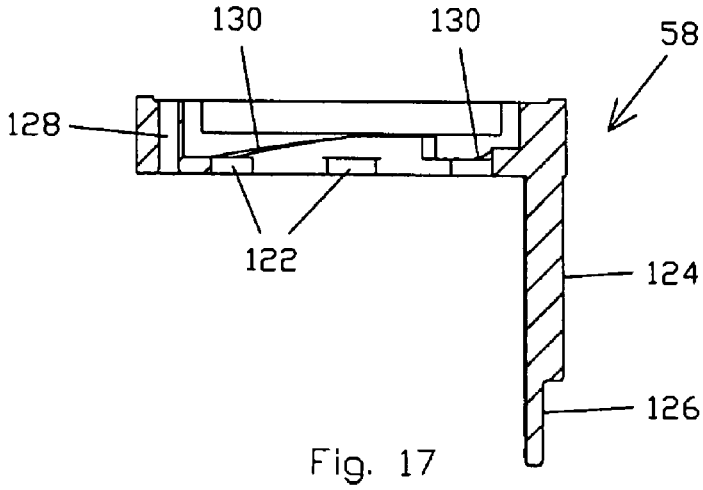
FIG. 17 is a section on the line XVII-XVII of FIG. 16.

Referring to FIGS. 15 to 17, detail of one of the set point adjustment rings 58, 60 is shown, the other being identical, but inverted. The set point adjustment ring 58 includes five inwardly directed spacers 122, identical to those of the offset adjustment ring 108, but without a key. On its outside, the set point adjustment ring 58 has a bar 124 that extends from its circumference in an axial direction and that has a narrow end 126. On the opposite side, the set point adjustment ring 58 defines an aperture 128 in which an end 126 of the other set point adjustment ring 60 is receivable with little clearance. On the inside of the ring 58, on the side opposite from that to which the bar 124 extends, three helical ramps 130 are defined.

Figure 18:
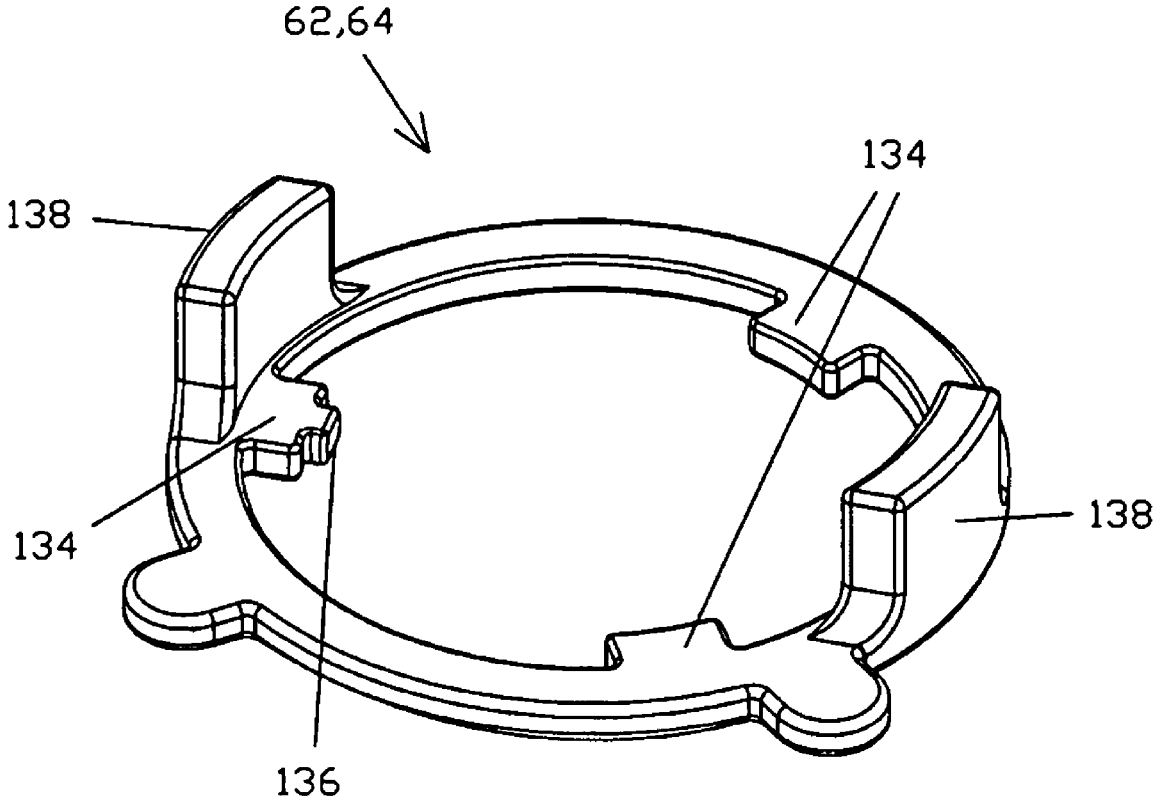
FIG. 18 is a three dimensional view of a collar of the diffuser of FIG. 2.
Figure 19:
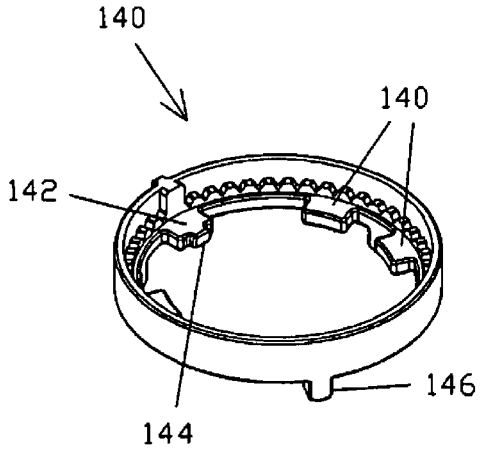
FIG. 19 is a three dimensional view of a retaining ring of the diffuser of FIG. 2.
Figure 20:
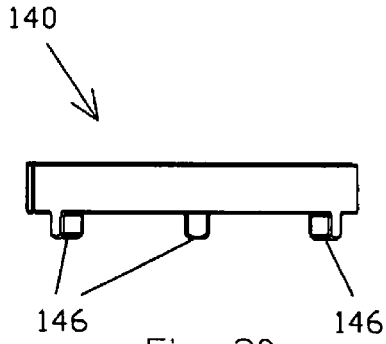
FIG. 20 is a side view of the retaining ring of FIG. 19.
Figure 21:
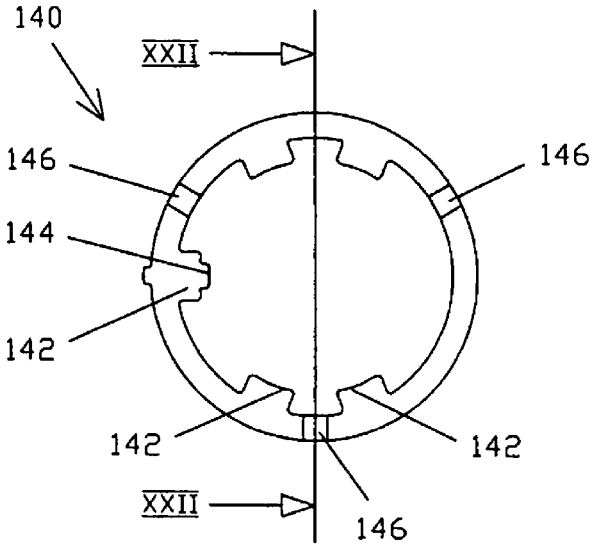
FIG. 21 is a bottom view of the retaining ring of FIG. 19.
Figure 22:
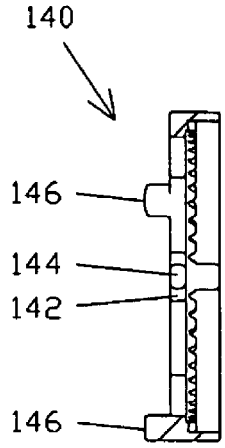
FIG. 22 is a section on the line XXII-XXII of FIG. 21.

Referring to FIG. 18, each of the collars 62,64 includes three inwardly extending spacers 134, identical to those of the offset adjustment ring 108 and set point adjustment rings 58,60 and one of the spacers 134 includes a key 136, identical to the key 120 of the offset adjustment ring 108. The keys 136 can slide axially in the groove 100 and owing to the positions of the collars 62,64 relative to the adjustment tube 70, the keys are held captive in the groove and prevent the collars from rotating relative to the tube 70, but permits movement of the collars in the axial direction. Each collar 62,64 defines two opposing circumferential cam ridges 138 that interact with the bosses 92 and 94 respectively.

Referring to FIGS. 19 to 22, the cartridge 10 includes a retaining ring 140, with spacers 142 and a key 144 on one of the spacers, identical to the spacers 118 and key 120 of the offset adjustment ring 108. The key 144 is held captive in the groove 100 and locks the retaining ring 140 against rotation. On its underside, the retaining ring 140 defines three circumferentially spaced protuberances 146, identical to the protuberances 114 of the offset adjustment ring 108.

The retaining ring is fitted on the adjustment tube 70 with its key 144 in the groove 100 and with its protuberances 146 pointing downwardly and is prevented from sipping off the tube 70, by a circlip 148 that fits inside the groove 106.

Referring now to all the figures, the cartridge 10 includes a set point adjustment mechanism 132, comprising of the top and bottom set point adjustment rings 58,60, the top and bottom collars 62,64 and the spring 66. When the mechanism 132 is assembled around the adjustment tube 70, the ends 126 of each of the bars 124 are received in the apertures 128 of the other set point adjustment ring, so that the set point adjustment rings are connected to rotate in unison around the tube 70, but can slide axially relative to each other. The spring 66 presses the collars 62,64 outwardly against the adjustment rings 58,60, which are in turn pressed against the upwardly facing protuberances 114 and the downwardly facing protuberances 146, which interact with the ramps 130.

When the set point adjustment rings 58,60 are rotated, the interaction of the protuberances 114,146 and the ramps 130 causes both adjustment rings 58,60 to move upwardly or to move downwardly together. It should be borne in mind that the protuberances 114,146 are prevented from rotating with the rings 58,60, since the key 144 is held captive within the groove 100 and the offset adjustment ring 108 is prevented from rotation, by the interaction of the teeth 112 with the ribs 104. The result is that the ridges 138 of both collars 62,64 are moved upwardly or downwardly in unison when the set point adjustment rings 58,60 are rotated.

The cartridge 10 also includes an offset adjustment mechanism 150, comprising of the offset adjustment ring 108, which is normally pressed downwardly by the spring 66 so that the teeth 112 and ribs 104 interact to keep the set point adjustment ring 108 from rotating. However, if the resistance of the teeth 112 and rib 104 is overcome by lifting the set point adjustment ring 108 to disengage the teeth from the ribs, the set point adjustment ring can be rotated manually so that its protuberances 114 are also rotated, with the result that the bottom set point adjustment ring 60 is moved upwardly or downwardly by the interaction of the protuberances 114 and the ramps 130 of the set point adjustment ring 60. At the same time, the top set point adjustment ring 58 remains stationary. The result is that the distance between the top and bottom set point adjustment rings 58,60 and consequently between the ridges 138 of the collars 62,64, can be adjusted by rotating the offset adjustment ring 108.

In use, the element 34 detects room temperature and the element 68 detects duct temperature. On the assumption that cooled air is flowing in the ducting D (e.g. during summer or when the diffuser is in its cooling operational condition), the piston of the element 68 is fully retracted. If it is further assumed that the room is cold, then the piston of the element 34 is also fully retracted, the wax in both elements 34, 68 having contracted. The baffle B is lifted to its uppermost position with the stopper 11 abutting the adjustment ring 24, so that no air flows, or a minimal amount of air flows.

As the room warms up, the wax in the element 34 expands and an upward thrust is exerted on the spindle 40 by the piston of the element 34. The upper end of the spindle 40 is against the piston of the element 68 and the piston of the element 68 cannot, because of the wax, move with respect to the element 68. Hence, the upward thrust exerted by the piston of the element 34 moves the spindle 40 and element 68 upwardly carrying the casing 36 as well as the tube 70, carrying the set point adjustment rings 58, 60 and the collars 62, 64, up with it, against the action of the springs 54,56. The underside of the ridges 138 of the top collar 62 bears down on the bosses 92 of the arms 12 to a lesser extent or not at all and they are free to tilt downwardly at their outer ends so that the baffle B drops and cool air flows into the room.

As the room and thus the element 34 cools, the reverse action occurs, the springs 54, 56 causing the spindle 40 and the element 68 to descend as the wax contracts. The diffuser thus returns to the initial condition and the top collar 62 moves downwardly so that it bears down on the bosses 92, thus lifting the arms 12 and baffle B so that flow of cold air is minimised. Thus room temperature is regulated.

In cool or cold atmospheric conditions (e.g. during winter or when the diffuser is in its heating operational condition), heated air flows in the duct D and the wax in the thermally sensitive element 68 expands. However, the spindle 40 cannot move downwardly as its lower end is against the piston of the element 34. Thus the body of the element 64 moves upwardly with respect to the piston of that element, carrying the casing 36, tube 70, set point adjustment rings 58,60 and collars 62,64 up with it against the action of the springs 54,56.

This movement is sufficient to separate the top collar 62 from the bosses 92 of the arms 12 and bring the ridges 138 of the bottom collar 64 into co-operating relationship with the bosses 94 of the arms.

As the element 34 cools with the room, the wax in it contracts. The springs 54, 56 exert a downward force. The spindle 40, element 68, tube 70 and bottom collar 64 descend, so that the ridges 138 of the bottom collar 64 bears on the bosses 94 to a lesser extent and the arms 12 are allowed to tilt downwardly to lower the baffle B and allow hot air to flow.

As the room heats up, the wax in the element 34 expands. Its piston thus tends to move upwardly pushing the spindle 40 upwardly. This lifts the tube 70 and bottom collar 64, including its ridges 138 that lifts the bosses 94. This results in lifting of the baffle B so that flow of heated air decreases.

As mentioned above, rotation of the set point adjustment rings 58,60 causes the ridges 138 to move upwardly or downwardly relative to the adjustment tube. The adjusted positions of the ridges 138 relative to the tube 70, results in more or less displacement of the bosses 92,94 upwardly and downwardly and thus results in more or less pivotal displacement of the arms 12. The adjustment thus simultaneously changes the "datum positions" of the arms 12 and changes the set points of the diffuser for both its heating and cooling operational conditions.

If it is desired to adjust the offset between the set points for heating and cooling conditions, this can be achieved by rotating the offset adjustment ring 108, which will affect the height of the ridges 138 of the bottom collar 64, relative to the adjustment tube 70, but not of the ridges of the top collar 62.

The present invention thus holds the advantage of allowing convenient simultaneous adjustment of the cooling and heating set point temperatures by operating the set point adjustment mechanism 132, i.e. rotating the set point adjustment rings 58,60, while maintaining the offset, but also holds the advantage of allowing the offset to be adjusted conveniently by rotating the offset adjustment ring 108.

The invention claimed is:

1. A diffuser for controlling flow of air in an air conditioning system, the diffuser including:

an air flow control baffle;

at least one pivotally mounted arm with an end connected to the baffle, said arm having a first cam surface on one side of its pivotal mounting and a second cam surface on the other side of its pivotal mounting;

a first control element having a first surface for bearing on said first cam surface and a second control element having a second surface for bearing on said second cam surface, said respective control elements being movable in an actuating direction towards and away from the respective cam surfaces;

set point adjustment means for coupling the first and the second control elements such that the control elements move in unison in the actuating direction when actuated; and offset adjustment means for moving the first control element in the actuating direction toward or away from the second control element to adjust an offset between the first and second control elements without moving the second control element.

2. A diffuser as claimed in claim 1, wherein the set point adjustment mechanism includes:

a first rotary element bearing on the first control element and including a helical formation, configured such that rotation of the first rotary element causes displacement of the first control element in the actuating direction;

a second rotary element bearing on the second control element and including a helical formation, configured such that rotation of the second rotary element causes displacement of the second control element in the actuating direction; and at least one connector extending between the first rotary element and the second rotary element, said connector causing the first rotary element and the second rotary element to be rotated together, causing displacement of the first and second control elements in unison, in the actuating direction.

3. A diffuser as claimed in claim 1, which includes a compression spring that extends between the control elements, urging them to abut their respective rotary elements.

4. A diffuser as claimed in claim 1, wherein the offset adjustment mechanism includes an offset adjustment element bearing on the helical formation of the first rotary element, rotation of the offset adjustment element causing displacement of the first rotary element and the first control element, in the actuating direction.

5. A diffuser as claimed in claim 4, wherein the offset adjustment mechanism is configured to limit rotation of the offset adjustment element and thus to limit movement of the first rotary element and the first control element.

6. A diffuser as claimed in claim 5, wherein rotation of the offset adjustment element is limited such that the set point for a heating condition of the diffuser is always lower than the set point for a cooling condition of the diffuser.

7. A diffuser as claimed in claim 5, wherein rotation of the offset adjustment element is limited such as to maintain a predetermined minimum offset between the set point for a heating condition of the diffuser and the set point for a cooling condition of the diffuser.

* * * * *